US007624506B2

(12) United States Patent
Melton et al.

(10) Patent No.: US 7,624,506 B2
(45) Date of Patent: Dec. 1, 2009

(54) DRIVING MEMBER FOR HAIR CUTTING DEVICE WITH REPLACEABLE TIP

(75) Inventors: Scott Melton, Erie, IL (US); Keith Dirks, Sterling, IL (US); Lawrence Meade Parry, III, Signal Mountain, TN (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 10/951,415

(22) Filed: Sep. 28, 2004

(65) Prior Publication Data

US 2006/0064878 A1 Mar. 30, 2006

(51) Int. Cl.
*B26B 19/02* (2006.01)
*B26B 19/38* (2006.01)

(52) U.S. Cl. ..... 30/216; 30/45; 30/43.91; 30/210

(58) Field of Classification Search ..... 30/210, 30/123, 216, 217, 218, 219, 220, 43.91, 45, 30/43.92

See application file for complete search history.

(56) References Cited

U.S. PATENT DOCUMENTS 871,082 A * 11/1907 Brigham ..... 30/45
1,956,042 A * 4/1934 Oster ..... 30/221
2,182,597 A * 12/1939 Oster ..... 30/210
2,294,713 A * 9/1942 Boerger ..... 30/123
2,510,844 A * 6/1950 Armbruster et. al. ..... 74/50
2,773,306 A * 12/1956 Ranson ..... 30/43.92
3,088,148 A * 5/1963 Moret ..... 15/22.1
3,104,405 A * 9/1963 Perrinjaquet ..... 15/22.1
3,136,058 A * 6/1964 Andis ..... 30/210
3,222,781 A * 12/1965 Ulke et al. ..... 30/210
3,279,062 A * 10/1966 Andis ..... 30/210
3,369,265 A * 2/1968 Halberstadt et al. ..... 15/22.1
3,412,463 A 11/1968 Rundzaitis
3,570,122 A * 3/1971 Williams ..... 30/210
3,589,007 A * 6/1971 Walton ..... 30/140
3,992,778 A * 11/1976 Urbush ..... 30/216
4,383,366 A 5/1983 Andis ..... 30/221
4,700,476 A * 10/1987 Locke et al. ..... 30/43.91
5,068,966 A 12/1991 Wahl et al. ..... 30/43.92
5,325,590 A 7/1994 Andis et al. ..... 30/216
5,606,799 A 3/1997 Melton ..... 30/216
5,819,415 A * 10/1998 Bruggers et al. ..... 30/223
6,076,263 A 6/2000 Andis et al. ..... 30/216
6,546,585 B1 * 4/2003 Blaustein et al. ..... 15/167.1
6,725,544 B1 * 4/2004 Wu ..... 30/144

OTHER PUBLICATIONS

Edlich, R.F., Jackson, E.M., and Arnette, J. "A scientific basis for selecting hair removal techniques" [online] University of Virginia School of Medicine. Available from http://www.liveabled.com/manual/Clipintro.cfm [Accessed May 24, 2006].

* cited by examiner

*Primary Examiner*—Hwei-Siu C Payer
(74) *Attorney, Agent, or Firm*—Greer, Burns & Crain, Ltd.

(57) ABSTRACT

A replaceable tip for a driving member of a clipper is configured to drive a moving blade. The replaceable tip is replaceable without disassembly of the clipper body.

6 Claims, 3 Drawing Sheets

DRIVING MEMBER FOR HAIR CUTTING DEVICE WITH REPLACEABLE TIP

BACKGROUND OF THE INVENTION

The present invention relates generally to hair cutting devices having a moving cutting blade and a drive system, and specifically to hair clippers having a bladeset driven by rotary motor systems.

One type of electric hair clipper used for cutting hair employs an electric motor with an eccentric drive member secured to the armature. A linkage converts rotary motion to linear reciprocating blade motion.

Conventionally, a pivoting or reciprocating driving member is used to drive a moving clipper blade of a clipper bladeset in a laterally reciprocating fashion with respect to a static clipper blade. The driving member has a contact portion which contacts the moving blade to drive the blade through the reciprocating motion. A considerable amount of wear occurs at a contact portion of the driving member, causing the contact portion to wear down or fail, while the remainder of the driving member remains relatively structurally sound and intact.

Typically, once the contact portion or tip is worn down or has failed, additional operational noise and/or reduced stroke results, causing insufficient and/or inefficient cutting. A user then has to replace the entire driving member, requiring some degree of disassembly of the drive system, and usually the clipper housing, to gain access and replace the driving member. The replacement process typically can require excessive time to disassemble and reassemble the clipper. This process is not only time consuming, but is also labor intensive and requires some mechanical inclination. Additionally, disassembly and reassembly can lead to further product failure when other clipper components are misaligned and/or damaged during the replacement process.

Thus, there is a need for a driving member assembly for a hair cutting device which addresses the drawbacks of the prior art.

BRIEF SUMMARY OF THE INVENTION

The above-identified needs are met or exceeded by the present replaceable tip for use with a driving member of a hair clipper. The replaceable tip is configured to drive a moving blade, and is constructed and arranged to be replaceable upon the drive member without disassembly of a clipper housing.

An alternate replaceable tip for a driving member of a clipper is also disclosed. The replaceable tip is generally rectangular and is disposed at the end of the driving member. The replaceable tip is configured to drive a moving blade.

A method of replacing a replaceable tip of a driving member without disassembling a clipper housing is also disclosed. The method comprises the steps of unfastening and removing a bladeset from the clipper housing. The replaceable tip is removed from the driving member, and a replaceable tip is disposed on the driving member. Then, the bladeset is disposed on and fastened to the clipper housing.

In another embodiment, a driving member having a replaceable tip for a hair clipper is configured to drive a moving blade of the hair clipper. The replaceable tip and the driving member are constructed and arranged for the replaceable tip to be replaceable upon the drive member without disassembly of a clipper housing.

DETAILED DESCRIPTION OF THE INVENTION

Figure 1:
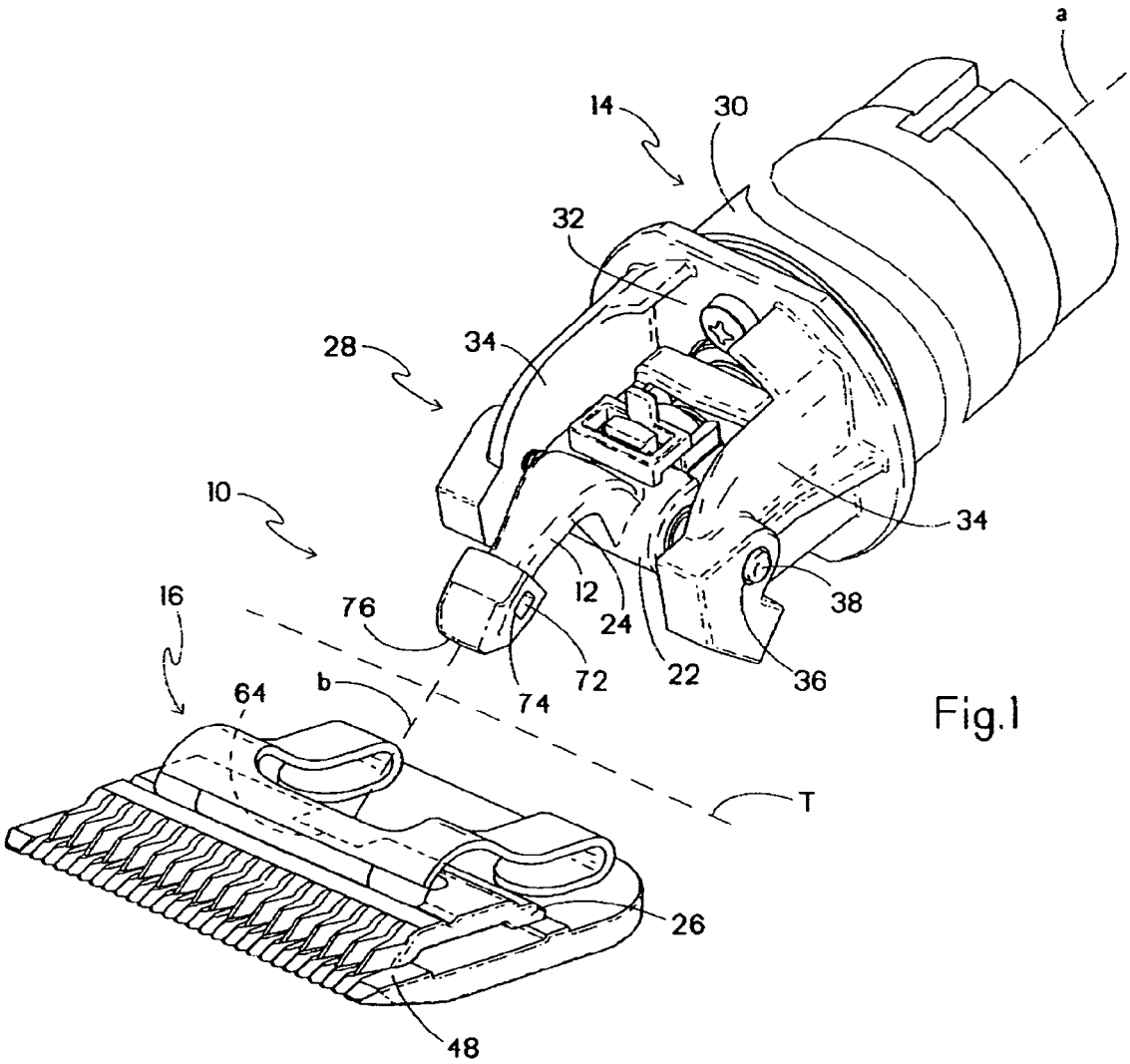
FIG. 1 is a perspective view of a driving member mounted in a hair clipper drive system and a replaceable tip disposed on the driving member with a bladeset shown exploded.
Figure 2:
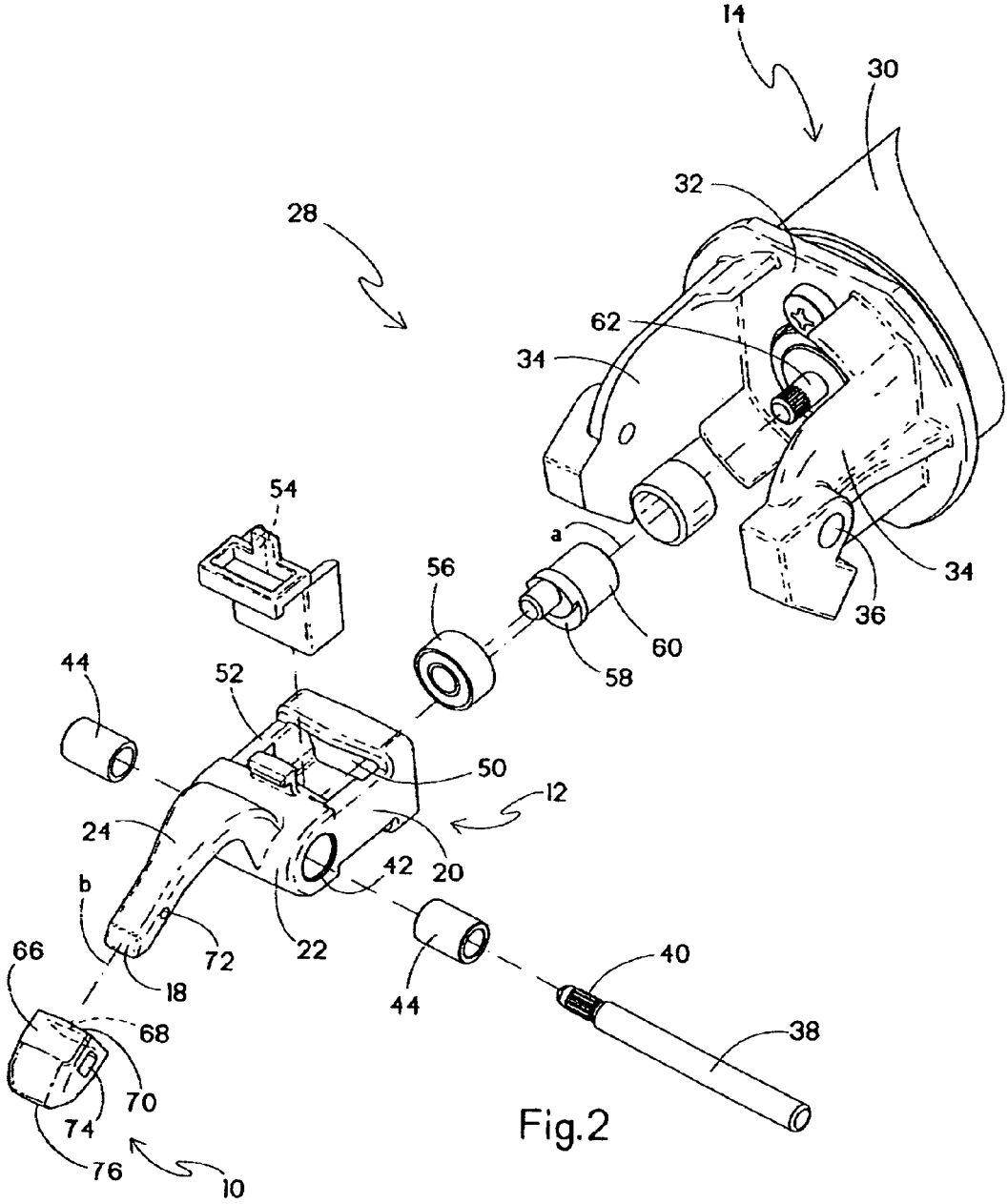
FIG. 2 is an exploded perspective view of the drive system of FIG. 1 with the replaceable tip disassembled from the driving member.

Referring now to FIGS. 1 and 2, a replaceable tip for a powered hair clipper is generally designated 10. While the present apparatus 10 is depicted as a replaceable tip on a driving member 12 for a hair clipper 14 that engages a bladeset 16, it is contemplated that the present principles of operation are convertible into any mechanical device associated with the use of a drive system that contacts a moving or reciprocating member. In particular, the replaceable tip 10 may be used on clippers, shavers, trimmers, and the like.

The replaceable tip 10 is configured to be removably disposed on a distal end 18 (FIG. 2) of the driving member 12. It is contemplated that any configuration of driving member 12 made of any material can be used. In the preferred embodiment, the driving member 12 is a rotary-to-linear mechanism having a body 20, a shoulder portion 22 and a neck 24, which are integrally formed of a material selected for durability, formability and affordability. The drive member 12 is preferably moved in a true linear fashion relative to the bladeset, so that the driving member moves linearly and reciprocally along an axis "T" transverse to a longitudinal axis "a" of the clipper 14. The reciprocating movement of the driving member 12 is parallel to the movement of a moving blade 26.

The driving member 12 operates as part of a drive system 28. The drive system 28 includes a motor assembly 30 and a chassis including a base plate 32 having a pair of spaced, generally parallel, normally projecting arms 34. Each of the arms 34 has a throughbore 36 dimensioned for receiving a respective end of a linear drive shaft or lateral guide shaft 38. The shaft 38 is oriented to be parallel to the operational axis of the moving blade 26 and defines an operational path for the driving member 12. One end 40 of the shaft 38 is preferably splined and is secured in a friction fit into the corresponding throughbore 36.

To facilitate linear sliding of the driving member 12 upon the shaft 38, the driving member includes a transverse throughbore 42. At least one and preferably two drive shaft bushings 44 are slidable upon the shaft 38 on an inner diameter, and are slidingly received in the throughbore 42 on an outer diameter.

In the driving member 12, the throughbore 42 is preferably located in the shoulder 22. Projecting from the shoulder 22 is the neck 24 having at its end 18 the removable tip 10. The tip 10, in turn is preferably configured to be fixed to the moving blade 26 of the bladeset 16. By fixing the relative displacement of the distal end 18 of the driving member 12 with the moving blade 26 (FIG. 1), the moving blade reciprocates laterally with respect to a stationary blade 48 and generally transverse to the longitudinal axis "a" of the clipper 14.

The body 20 defines a chamber 50 having an upper opening 52 which provides access to a cam follower 54. The cam follower 54 defines the lateral stroke of a bearing 56 rotatably engaged on a cam lug 58 of an eccentric cam 60. In operation, an armature 62 turns under power from the motor 30, the eccentric cam lug 58 follows an eccentric path defined by the cam follower 54, and the driving member 12 is pushed to move laterally along the linear shaft 38. Thus, the rotary motion of the motor assembly 30 is translated to the linear motion of the moving blade 26. While the present invention has been described with respect to a rotary to linear drive system 28, any electric motor powered appliance drive system that activates a moving or reciprocating member is contemplated.

The replaceable tip 10, when disposed on the distal end 18 of the driving member 12, is the portion of the driving member that contacts the moving blade 26. Typically, the moving blade 26 has a receiving formation 64 (shown hidden) configured for receiving the replaceable tip 10. In the preferred embodiment, the receiving formation 64 is a notch or groove that accommodates and mates with the replaceable tip 10 so that the transverse motion of the neck 24 is translated to the moving blade 26. Preferably, the replaceable tip 10 is tightly engaged with the receiving formation 64, however, it is contemplated that slight displacement of the receiving formation relative to the replaceable tip can occur.

When the driving member 12 translates a motion generally transverse to the longitudinal axis "a" of the clipper 14, the replaceable tip 10 is configured to remain confined within the receiving formation 64. Preferably, the replaceable tip 10 does not move in-or-out or up-and-down relative to the receiving formation 64, thereby lessening the wear introduced by impact stresses, and prolonging the life of the replaceable tip 10.

However, through use, the replaceable tip 10 will experience wear relative to the receiving formation 64. Such wear will increase the amount of play of the tip 10 in the receiving formation 64, will decrease the efficiency of the drive system 28, will usually increase operational noise of the clipper 14, and becomes generally undesirable. When the replaceable tip 10 wears down or otherwise fails, an advantage of the present replaceable tip is that it can be replaced without disassembling the drive system 28 to replace the entire driving member 12. Instead, only the bladeset 16 has to be removed from the clipper 14 to gain access to the replaceable tip 10. This is typically accomplished by exerting pressure on the moving blade 26 side of the bladeset 16 to unclip the bladeset from the clipper 14, releasing a snap fit. Alternatively, if fasteners are used to secure the bladeset to the housing, the fasteners are unfastened and the bladeset is pulled away from the clipper 14. In other units, a lock member needs to be released or moved to allow detachment of the bladeset. In such cases, the clipper body does not have to be disassembled. In some hair clippers 14, the bladeset 16 is secured to the clipper with only a snap-fit. Then, the replaceable tip 10 can be pulled off from the neck 24 of the driving member 12 with the user's fingers, a pliers, or the like. When a new replaceable tip 10 is engaged on the driving member 12, preferably by being pressure fit on the neck 24, the bladeset 16 can be refastened to the clipper 14.

Referring now to FIGS. 1 and 2, the first embodiment of the replaceable tip 10 is generally rectangular with an engagement portion 66, preferably a counterbore, configured to receive the distal end 18 of the neck 24. An opening 68 (shown hidden) to the engagement portion 66 is disposed on a proximal side 70 of the tip 10, and the neck 24 is introduced into the opening 68. The replaceable tip 10 is pressure fit over the neck 24 and is preferably secured into place to encapsulate the distal end 18 of the driving member 12.

At least one, but preferably a plurality of driving member retainer structures 72, such as snaps, lugs, bosses or ridges, are disposed on the neck 24 to be engaged in corresponding tip retainer structures 74, such as snap holes or grooves. It is also contemplated that other retainer structures may 72, 74 be used to retain the replaceable tip 10 on the distal end 18 of the driving member 12. When the driving member retainer structures 72 and the tip retainer structures 74 are engaged, the neck 24 extends within the replaceable tip 10 substantially along the length of the tip, but the neck preferably does not protrude through an opposite side 76 of the tip. In the preferred embodiment, the opposite side 76 is radiused in both the normal and longitudinal directions with respect to the clipper 14. This configuration provides a locating function with the receiving formation 64, as well as provides a curved impact surface when the replaceable tip 10 is used for arcuate motion (See FIGS. 3-5).

Figure 3:
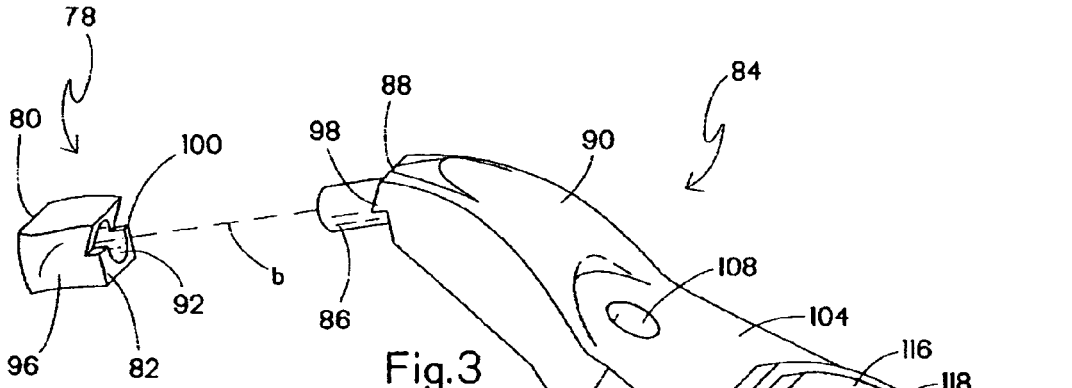
FIG. 3 is an exploded perspective view of a second embodiment of the replaceable tip disassembled from the driving member.
Figure 4:
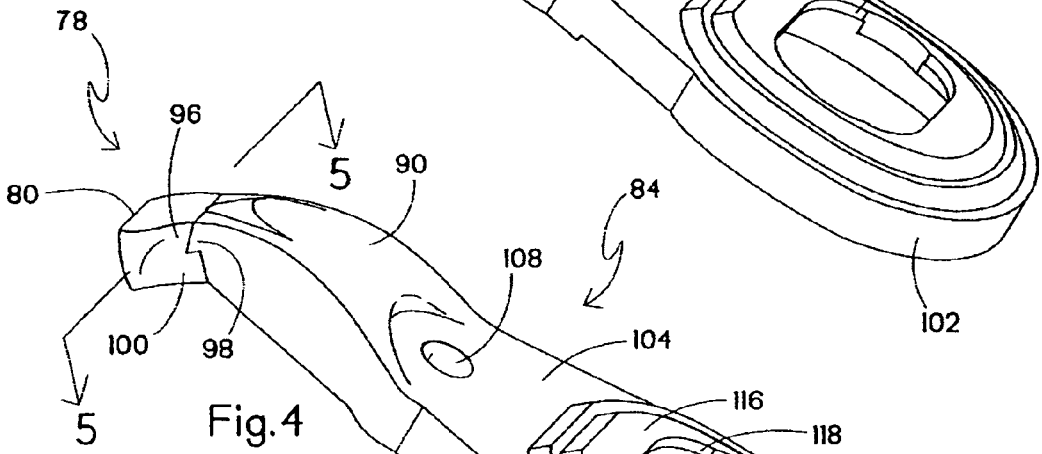
FIG. 4 is an assembled perspective view of the replaceable tip and the driving member of FIG. 3.
Figure 5:
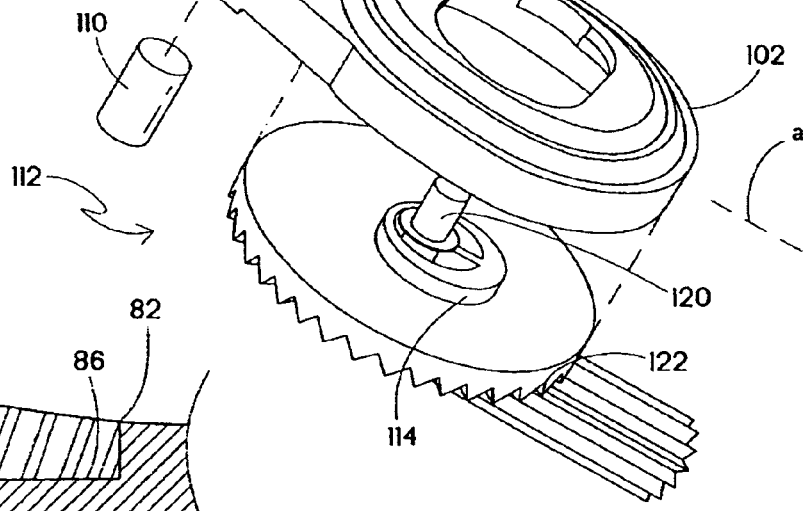
FIG. 5 is a section view of the replaceable tip and the driving member taken along the line 5-5 of FIG. 4.
Figure 5:
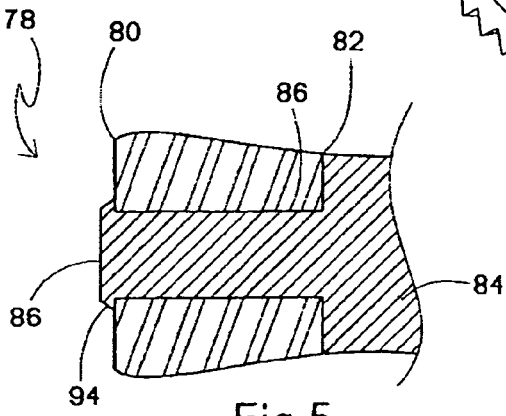

Referring now to FIGS. 3-5, an alternate embodiment of a replaceable tip is designated generally as 78. The replaceable tip 78 is generally rectangular with a wide end 80 and a tapered end 82 (FIG. 5). Similar to the first embodiment, the tip 78 has an engagement portion 92. However, in the second embodiment, the engagement portion 92 is preferably a throughbore that extends from the tapered end 82 all the way through the tip 78 to the wide end 80.

In the corresponding driving member 84, a driving member engagement portion 86, preferably a pin, is preferably integrally formed to protrude from the distal end 88 of a neck 90 to be received in an engagement portion 92 of the replaceable tip 78. When the pin 86 is introduced at the tapered end 82, the pin slightly protrudes from the wide end 80. Additionally, the pin 86 has a slight flare 94 (FIG. 5) for maintaining the relative location of the pin within the engagement portion 92. Alternatively, the pin 86 can be flush with the wide end 80 or the pin can extend less than the entire length of the replaceable tip 78. Other configurations are contemplated provided the replaceable tip 78 is secured to the driving member 84.

The wide end 80 of the replaceable tip 78 is received in the receiving formation 64 of the moving blade 26. The replaceable tip 78 has side ends 96 that are preferably slightly concave in the direction normal to the engagement portion 92, as shown in FIG. 3, or in any other manner configured to restrain the tip within the receiving formation 64. Contacting the moving blade 26 with the wide end 80 of the replaceable tip 78, and any additional contouring of the tip, provides additional engagement of the tip within the receiving formation 64.

The tapered end 82 of the replaceable tip 78 and the driving member 84 preferably have a first and second locking formation 98, 100, such as a mating "V"-shaped geometry, to prevent rotation of the tip 78 relative to the driving member. Also preventing the rotation of the replaceable tip 78 relative to the driving member 84 is the engagement portion 92 and the pin 86, both of which are preferably shaped to have a slight eccentricity about the longitudinal axis "b" of the replaceable tip. In the embodiment of the tip 78, the axis "b" is oblique to the clipper axis "a", however, other orientations are contemplated depending on the application. It is also contemplated that other shapes of engagement portions 86, 92 can be used, particularly if configured to mate but not rotate with respect to each other. Further, a configuration having a circular pin 86 and engagement portion 92 is contemplated where the additional restraint of the eccentricity is not desired, as long as relative motion of the tip to the driving member 84 is prevented.

The driving member 84, like the driving member 12, is a rotary-to-linear mechanism having a body 102, a shoulder portion 104, and the neck 90, which are integrally formed of a material selected for durability, formability, and affordability. Preferably, the shoulder 104 is pivotally attached to the clipper 14 at a pivot bore 108. As the body 102 is driven by the motor assembly 30, the shoulder 104, as well as the neck 90, moves relative to the clipper 14, by sliding generally transverse and arcuate to a longitudinal axis "a" of the clipper about a rod 110. In this embodiment, a distal end 88 of the neck 90 travels in a slightly arcuate path.

Driving of the body 102 is preferably effected by coupling the driving member 84 to the motor assembly 30 forming a drive system 112. In particular, the drive system 112 preferably has an eccentric cam 114 that protrudes upwardly from the drive system into a cam-receiving portion 116 of the body 102. The cam-receiving portion 116 preferably includes an opening 118 in the body 102 configured to accommodate and generally circumscribe the cam 114. In a preferred embodiment, the cam 114 is preferably round with a hollow center configured to be disposed eccentrically around a stationary shaft 120. When the motor 30 drives the drive member 84, a gear drive 122 rotates the cam 114 about the stationary shaft 120, and the eccentricity of the cam induces the body 102 to pivot about the pivot rod 110.

It is contemplated that other embodiments of driving members can be used. In one contemplated embodiment of a driving member (not shown), the driving member preferably has two legs fixedly attached to a clipper at a first end, and a bridging structure between the legs at a second end. Each leg is preferably resilient and is configured to deform. Preferably, a cam, or other mechanical member, is coupled to the bridging structure to drive the driving member. When the cam imparts transverse motion on the bridging structure, the legs of the driving member deform, and the replaceable tip 10, 78 disposed on the bridging structure reciprocates. The replaceable tip 10, 78 has an engagement portion that is configured to engage the driving member at a distal end, preferably at the bridging structure, such as by snapping, sliding, fastening, pressure fitting, or any other method. Further, it is contemplated that the replaceable tip 10, 78 may engage both the driving member and the cam (or similar mechanism), such that cam directly imparts force on the tip.

A detailed description of the preferred drive mechanism is disclosed in U.S. Pat. No. 7,346,990, entitled "Rotary Motor Clipper with Linear Drive System", which is incorporated by reference herein.

While specific embodiments of the present replaceable tip and method of replacement have been shown and described, it will be appreciated by those skilled in the art that changes and modifications may be made thereto without departing from the invention in its broader aspects and as set forth in the following claims.

What is claimed is:

1. A hair clipper comprising: a replaceable tip, a driving member, a moving blade, and a housing, wherein said driving member is configured to drive the moving blade through a reciprocating motion, said tip having a radiused end which is radiused in both the normal and longitudinal directions with respect to the clipper for directly engaging a receiving formation in the moving blade and driving the moving blade during operation of said hair clipper, said radiused end configured for facilitating location of the tip in the receiving formation and designed to wear over time through operational engagement with the formation, and for being replaceable upon the driving member without disassembly of the clipper housing, wherein said tip is provided with a counterbore engagement formation configured to receive a distal end of the driving member, said tip is configured to be removable and replaceable on the driving member generally coaxially to the driving member, said tip including at least one hole in said engagement formation configured to receive a corresponding locking lug on the driving member in a snap-fit locking relationship, said hole on said tip being configured so that said snap-fit locking relationship between said tip and the driving member is overcome by a force in a coaxial direction.

2. The hair clipper of claim 1, wherein said tip translates arcuate motion to the moving blade with respect to a static blade.

3. The hair clipper of claim 1, wherein said radiused end is rounded in at least one of a longitudinal and a normal direction with respect to the clipper, wherein said radiused end is configured for translating arcuate motion to the moving blade.

4. The hair clipper of claim 1, wherein the distal end of the drive member has a profile, and said radiused end of said tip has a complimentary profile to that of the distal end.

5. A hair clipper comprising: a housing, a driving member, a unitary replaceable tip configured for direct, driving contact with a reciprocating moving blade on the hair clipper during operation of said hair clipper and as such to be subject to wear through said direct contact, said tip having a radiused end which is radiused in both the normal and longitudinal directions with respect to the clipper and is provided with a counterbore engagement formation configured to receive a complementary distal end of said driving member, said radiused end being configured with a complementary profile to correspond to said distal end of said driving member, said replaceable tip and said driving member constructed and arranged for said replaceable tip to be replaceable upon said driving member without disassembly of the clipper housing, said tip being removable and replaceable on said driving member generally coaxially to said driving member, said tip and said driving member each having at least one locking formation including at least one of a lug and a hole, said lug being configured to engage said hole to inhibit axial movement of said tip relative to the driving member, said lug and said hole forming a snap-fit locking relationship that is overcome by a force in a coaxial direction, said locking formation on said tip being located in said counterbore engagement formation.

6. The hair clipper of claim 5 wherein said lug is in the form of one of a snap, a boss and a ridge on said driving member.

* * * * *

UNITED STATES PATENT AND TRADEMARK OFFICE

CERTIFICATE OF CORRECTION

PATENT NO. : 7,624,506 B2
APPLICATION NO. : 10/951415
DATED : December 1, 2009
INVENTOR(S) : Melton et al.

It is certified that error appears in the above-identified patent and that said Letters Patent is hereby corrected as shown below:

In the Specification:

Col. 2, Line 39: delete "drive" and replace with --driving--.

In the Claims:

Col. 6, Lines 32/33: delete "a driving member, a unitary replaceable tip" and replace with --a driving member in combination with a unitary replaceable tip--.

Signed and Sealed this

Sixth Day of July, 2010

David J. Kappos

David J. Kappos
*Director of the United States Patent and Trademark Office*